United States Patent [19]

Lines

[11] 4,005,551

[45] Feb. 1, 1977

[54] CAM OPERATED STONE GRINDING DEVICE

[76] Inventor: Roy C. Lines, Box 383, Oriska, N. Dak. 58063

[22] Filed: Apr. 7, 1975

[21] Appl. No.: 565,418

[52] U.S. Cl. ..... 51/101 R

[51] Int. Cl.[2] ..... B24B 17/02

[58] Field of Search ..... 51/101 R, 101 LG, 127; 90/13.1, 3.6, .9

[56] References Cited

UNITED STATES PATENTS

| | | | |
|---|---|---|---|
| 1,109,405 | 9/1914 | DiGianni | 51/101 LG |
| 1,226,329 | 5/1917 | Hansen | 51/101 LG |
| 1,228,418 | 6/1917 | Eaton | 51/101 LG |
| 1,324,454 | 12/1919 | LaFortune | 51/101 LG |
| 1,422,055 | 7/1922 | Henker | 51/101 LG |
| 1,474,171 | 11/1923 | Schumann | 51/101 LG |
| 1,659,560 | 2/1928 | Bausch | 51/101 LG |
| 2,334,938 | 11/1943 | Lang | 51/101 R |
| 2,415,062 | 1/1947 | Green | 51/101 R |
| 3,449,866 | 6/1969 | Suddarth | 51/101 R |
| 3,864,879 | 2/1975 | Naismith | 51/101 R |

*Primary Examiner*—Al Lawrence Smith
*Assistant Examiner*—Nicholas P. Godici
*Attorney, Agent, or Firm*—Robert E. Kleve

[57] ABSTRACT

The invention comprise a stone shaper device for shaping neck pendants into various desired shapes and sizes. The device has a main frame and a frame slidable on the main frame and a cam shaft having cams of various sizes and shapes on the cam shaft, with a pair of arms pivotally mounted at their one ends to the sliding plate and the cam shaft rotatably mounted to the other ends of the arms, and means to rotate the cam shaft, an adjustable roller is adjustable into a position in front of a selected one of the cams. A stone for grinding into a selected shape is mounted perpendicular to one end of a grinding shaft and the cam shaft has a chuck at one end to receive and lock the grinding shaft therein. Spring means are provided to urge the cam shaft toward the roller so that the selected one of the cams may engage the roller and so that when the selected one cam is rotated by the cam shaft it will push the cam shaft away and allow it to move toward the roller depending upon the variations in the selected cam so that a grinding wheel adjacent the stone for grinding will guide the stone into the shape of the selected one cam.

1 Claim, 4 Drawing Figures

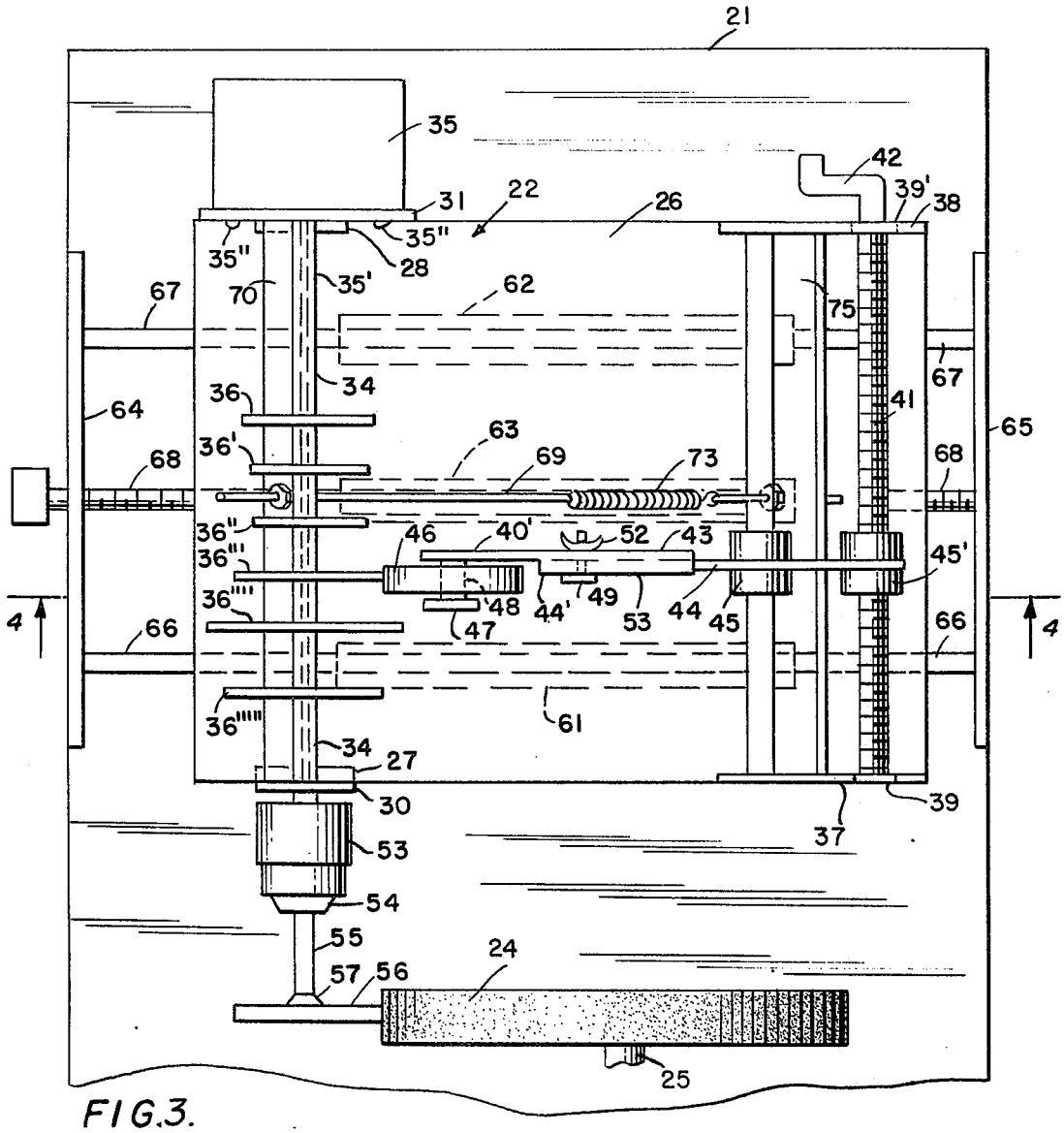
FIG.3.
FIG. 4.
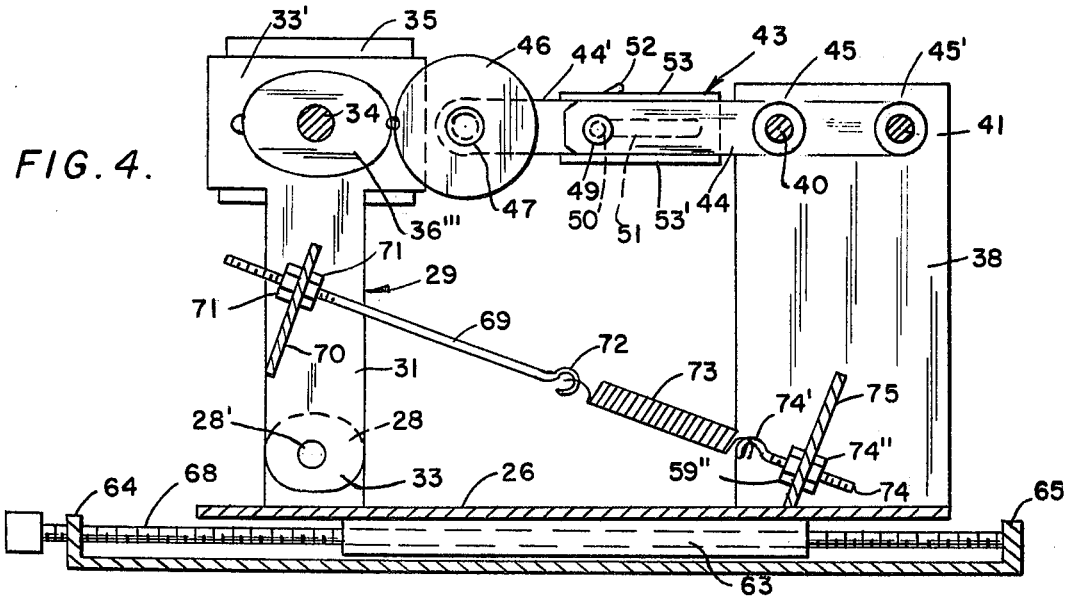

CAM OPERATED STONE GRINDING DEVICE

This invention relates to stone shaping equipment.

It is an object of the invention to provide a novel stone shaping apparatus which has a plurality of cams of different shapes and which is adjustable to a selected cam with the cam acting to guide the grinding of a stone so that the stone can be ground to the shape of the selected cam.

It is an object of the invention to provide a novel stone shaping apparatus which has a plurality of cams of different sizes and shapes corresponding to the shapes of the neck pendants and which cam acts to guide the guiding of a stone so that stone is ground to the shape of the selected cam.

It is another object of the invention to provide a novel stone shaping apparatus having a plurality of cams to guide the grinding of stone into the shape of the selected cam.

Further objects and advantages of the invention will become apparent as the description proceeds and when taken in conjunction with the accompanying drawings wherein:

FIG. 3 is a fragmentary top plan view of the stone shaping apparatus.

FIG. 4 is a cross-sectional view of the stone shaping apparatus taken along line 4–4 of Fig. 3.

Briefly stated, the invention comprises a stone shaping apparatus to shape stones of neck pendants to desired shapes, said apparatus having a plurality of cams of different shapes and sizes corresponding to various different stones of neck pendants, said cams being fixed to a cam shaft, a roller acts as a cam follower, said roller being adjustable to a position in front of a selected cam, said cam shaft being rotatably mounted to a pivotal support plate, a motor on said support plate to rotate said cam shaft, a stone to be shaped glued to a rod, with said rod mounted in a chuck at the end of said cam shaft, a grinding wheel adjacent said stone to be shaped, spring means to urge the cam shaft toward the cam roller, said grinding wheel being adjusted so that when the cam shaft and selected cam is urged toward the cam roller, said stone to be shaped is urged toward the grinding wheel so that the selected cam engages the cam roller as the cam shaft rotates and simultaneously the stone to be shaped engages the grinding wheel so that the grinding wheel shapes the stone to be shaped to correspond to the selected cam.

Figure 1:
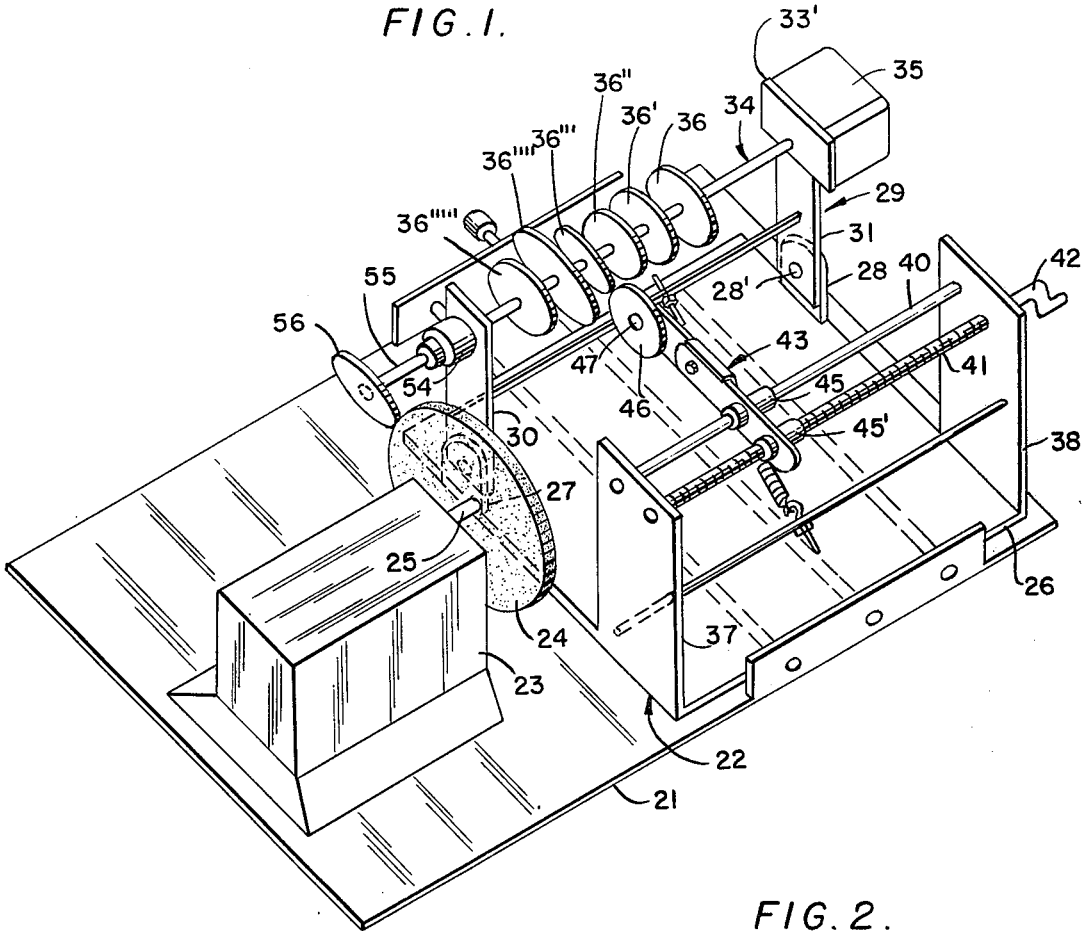
FIG. 1 is a perspective view of the stone shaping apparatus.

Referring more particularly to the drawings, in Fig. 1, the stone shaping invention 20 is illustrated. The stone shaping apparatus has a main frame 21. A sliding frame 22 is slidably mounted on the main frame. An electric motor 23 is fixed to the main frame. The electric motor 23 has a grinding wheel 24 fixed coaxially to the output shaft 25 of the electric motor.

The sliding frame 22 has a base plate 26. A pair of mounting flanges 27 and 28 are fixed on opposite edges of the plate 26. A cam shaft support apparatus 29 has a pair of upright side plates 30 and 31 pivotally mounted at their lower ends 32 and 33 to the mounting flanges 27 and 28 on pins 27′and 28′. A cam shaft 34 is rotatably mounted in the upper portions 32′ and 33′ of the side plates 30 and 31. An electric motor 35 is fixed to the side plate 31 by bolts 35″. The output shaft of the electric motor 35 is fixed axially to the cam shaft 34 so that the energizing of the electric motor 35 rotates the output shaft 35′ which in turn rotates the cam shaft relative to side plates 30 and 31.

The cam shaft 34 has a plurality of different size cams 36 – 36″″″ having different sizes and shapes.

A pair of rear side plate supports 37 and 38 are fixed on opposite sides of the base plate of the sliding plate. The rear side plates 37 and 38 have a pair of sleeve type bearings 39 and 39′, respectively, with the bearings 39 and 39′ aligned coaxially with one another. A shaft 40 is fixedly mounted inbetween side plates 37 and 38 and a shaft 41 is rotatably mounted in bearings 39 and 39′ of plates 37 and 38. The shaft 41 has external threading.

A cam idler wheel apparatus 43 has a plate 44 with a pair of sleeve type bearings 45 and 45′ fixed to one end of the plate in bores at spaced intervals. The sleeve bearing 45 has a smooth cylindrical inner surface to slide freely on the shaft 40. The sleeve bearings 45′surrounds shaft 41 and has a threaded inner surface to mate and engage with the external threaded surface of shaft 41 whereby rotation of shaft 41 will cause the sleeve 45′ to move forward and rearward along the shaft 41 thereby moving the plate 44 forward and rearward along the shaft 41 with the other bearing sleeve 45 sliding freely on the shaft 40 as the plate 44 moves forward and rearward in a rectlinear manner.

The shaft 41 has a crank 42 at its outer end to rotate the shaft 41.

The roller wheel 46 is rotatably mounted on a bolt 47 which bolt 47 passes through a bore 48 in the wheel with the other side of the bolt being fixed to the plate 44′. The wheel has a relatively hard outer cylindrical surface.

The plate 44′ is slidably adjustable on the plate 44 by means of a bolt 49 which passes through a bore 50 in plate 44 and through an elongated slot 51 in plate 44′. A wing nut 52 is threaded onto the outer end of the bolt 49 to lock plate 44 to plate 44′. The plate 44′ has overhanging upper and lower flanges 53 and 53′ which project over the upper and lower edges of plate 44 to maintain the plates in parallel alignment as illustrated.

Figure 2:
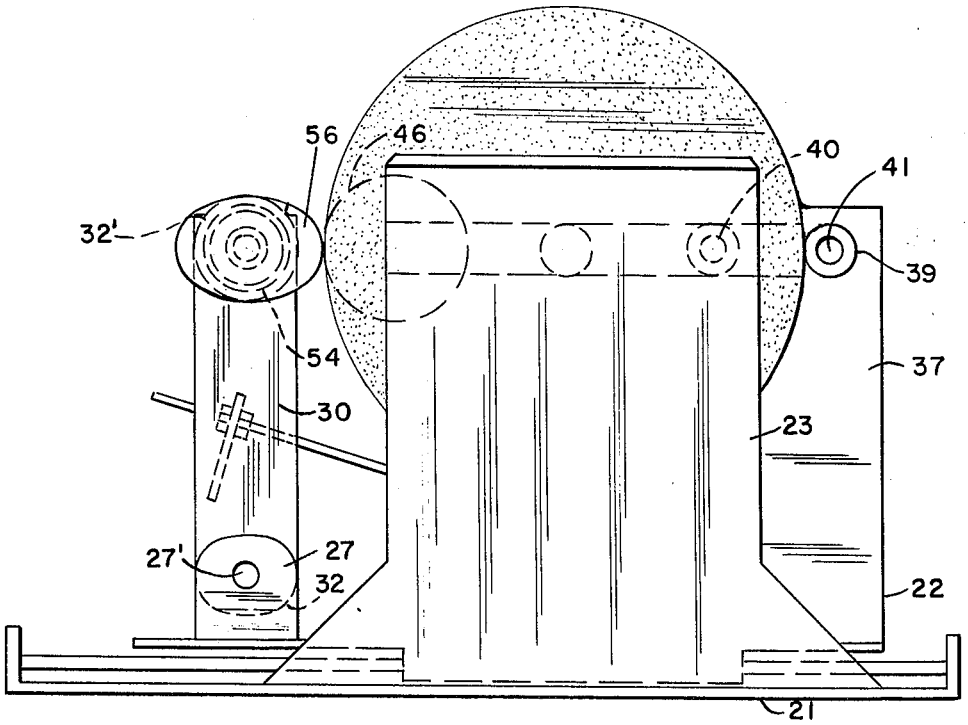
FIG. 2 is an end view of the stone shaping apparatus.

The plate 44′ may be slid from left to right or visa versa to adjust the roller 46 toward or away from cam shaft 34 from its position shown in Figs. 2 and 3 by loosening the wing nut 52 and sliding the plate 44′ along plate 44 with the bolt 49 sliding in the slot 52 and then retightening the wing nut 52.

The rotation of the crank 42 rotates the shaft 41 with the threading in the shaft 41 engaging the threading on the sleeve 45′ to move the sleeve 45′ longitudinally on the shaft 41 thereby moving the plate 44, the plate 44′, and the roller wheel 46 axially on the shafts 40 and 41 laterally and parallel to cam shaft and relative to the cam shaft in one direction or the other depending upon the direction of rotation of the crank.

A conventional drill type chuck 54 is fixed coaxially to one end of the cam shaft 34. The nose and mouth of the chuck 54 has an adjustable opening to receive a shaft 55 in the jaws 54′ with a rotatable collar which is rotatable to lock and tighten the jaws 54′ about the stick to lock the stick 55 in coaxial relation to the chuck and cam shaft so that the cam shaft, chuck, and stick rotate together.

A stone 56 to be shaped has been previously glued to the shaft 55 by glue 57, a previous operation with conventional glue. The glueing of the shaft 55 to the stone 56 is done with a conventional glue commonly used in stone shaping in a separate operation to align and fix the shaft 55 centrally on the stone. The glue has sufficient strength to hold the stone 56 on the shaft when rotating and grinding the stone.

When the cam support apparatus pivots about pivot mounting 27′ and 28′ on the side plates 30 and 31, the electric motor 35, cam shaft 34, cams 36 – 36′′′′, chuck 54, shaft 55, and stone 56, also pivot about pivot points 27 and 28′ on the side plates 30 and 31 all in unison and moving as one unit as these components are all supported on the side plates 30 and 31. The connecting lateral plate 70 and rod 69 also move with the plates 30 and 31.

The cam shaft support apparatus 29 is spring urged or spring loaded to pivot toward and against the roller wheel 46 toward and against the grinding wheel by a rod 69 fixed to a lateral plate 70 by nuts 71 which plate 70 is fixed between the side plates 30 and 31. The rod 69 has a hook 72 at its outer end and a coil spring 73 is hooked at one end to hook 72 and the coil spring 73 is hooked at its other end onto a hook 74′ of a rod 74. The rod 74 is fixed to a plate 75 by a pair of nuts 74′′ threaded onto the rod 74 from against opposite sides of the plates. The plate 75 is fixed between the rear side plates 37 and 38. The spring 73 draws the plate 70 toward the rear side plates 37 and 38 and the lateral plate 70 being fixed between side plates 30 and 31 pivots the side plates 30 and 31, the cam shaft 34, cams, and motor 35 toward the roller wheel 46 pivoting about the pivot points 27′ and 28′ causing cam 36′′′ to engage against the roller wheel 46. The cam shaft also pivots the chuck 54, shaft 55, and stone 56 about pivot point 27′ and 28′ to engage against the grinding wheel 24.

The sliding plate 26 is slidably mounted on the plate 21 by three sleeves 61, 62, and 63 fixed to the underside of base plate 26 of plate 22 in spaced parallel relation. The main frame 21 has a pair of upright flanges 64 and 65 fixed to its opposite edges. Two cylindrical rods 66 and 67 are fixed between the upright flanges 64 and 65 in spaced parallel relation and the sleeve 61 and 62 are slidably mounted on the cylindrical rods 66 and 67. A third shaft 68 has external threading and the sleeve 63 has internal threading and threaded onto shaft 68. The third shaft 68 is rotatably mounted in the upright flanges 64 and 65 in spaced parallel relation between the rods 66 and 67. The shaft 68 has a knob fixed to its outer end and the rotation of the knob rotates the shaft 68 and because of its threaded engagement with sleeve 63 it moves the sleeve 63 forward and rearward along a straight line coaxially with the sleeves 61, 62, and 63 from right to left or left to right, depending upon the direction of rotation of the knob, as viewed from Fig. 2

The moving of plate 26, by rotation of shaft 68 moves the entire assembly or plate 22, including the cam support apparatus, rear side plates, shafts, and roller wheel assembly.

OPERATION

Before the operator begins the grinding operation he will normally have a supply of unshaped stones and he will glue shafts 75 centrally onto each of these stones before hand so that the glue has hardened and so as to have as ample supply on hand for grinding selected shaped stones. The unshaped stones will be at least equal to or larger than the selected cam or cams on the cam shaft, in all directions radially from the shaft 75.

Then when an operator wishes to grind a stone for a neck pendant he will select one of the cams on the cam shaft which has a size and shape desired.

Assuming for purposes of illustration he has selected for a neck pendant stone, a stone of the size and shape of cam 36′′′. Having selected the shape of the cam he will grasp the cam shaft apparatus and pivot it counterclockwise from its position shown in Fig. 2 far enough so that the stone will clear the grinding wheel while held in this position, he will insert the shaft of one of the unshaped stones into the chuck and lock it in the chuck as illustrated in Fig. 1. He will still keep the support apparatus pivoted sufficiently from the roller so that the roller can clear the cam and rotate the crank to move the plates 44 and 44′ and roller 46 on shafts 40 and 41 parallel to the cam shaft until the roller aligns with the cam 36′′′. He will release the cam shaft to allow the spring to pivot it back clockwise toward the roller and until the unshaped stone touches the grinding wheel. The unshaped stone being larger than the cam will contact the grinding stone before the selected cam can contact the roller. He will now energize the grinding wheel motor and the cam shaft motor. The cam shaft will rotate the cam shaft and cams while the grinding wheel motor will rotate the grinding wheel. The cam shaft will be rotated much slower than the grinding wheel. It will be adequate if the cam shaft motor rotates the cam shaft in the range approximately 10–20 revolutions per minute or slower if desired while the grinding wheel will rotate at a conventional speed. The selected cam when its portions 81 having a large radius engage the roller, will cause the cam support apparatus including cams and cam shaft to pivot counterclockwise away from the roller about the pivot points as shown in FIG. 2. The selected cam when its portions have a smaller radius 82 engage the roller, the selected cam will cause the cam support apparatus including the cam and cam shaft to pivot toward the roller clockwise past its position shown in FIG. 2.

Since the unshaped stone in the chuck is then pivoted toward and away from the grinding wheel with the cam support apparatus in response to the changes in the radius of the cam about the pivot points 27′ and 28′, the stone will be ground into the shape of the selected cam with the pivoting action of the cam apparatus in response to the selected cam engagement causing the stone to be ground into the shape of the selected cam.

The grinding will continue when the selected cam is in continuous engagement with the wheel 46 which means the grinding is completed as the stone has taken on the shape and size of the selected cam.

The device is illustrated with the forward edge 83 of the wheel 46 aligned with the forward edge of the grinding wheel along line 84 as illustrated in FIG. 2 and 3 so that the stone to be shaped will not only have the same shape as the selected cam but will have the same size as the selected cam.

If the operator wishes to have a stone shaped in the same shape as the selected cam, but somewhat smaller than the selected cam, he will loose the nut 52 and slide the roller 46 and plate 44′ from left to right from its position when viewed from Fig. 2 relative to plate 44 a selected amount to thereby move the forward edge 83 of the roller to the right of the line 84 and to the right of the forward edge of the grinding wheel.

He will back the sliding plate 26 from right to left by the shaft 69, when viewed from FIG. 2, a sufficient amount so that the stone to be shaped can be attached by its stick in the chuck. He will than move the plate 26 from left to right when viewed from FIG. 2 gradually with the grinding wheel energized and the motor energized. The grinding will continue as the plate is moved slowly from left to right until the selected cam is in continuous engagement with the roller as it rotates. The stone will have been ground into generally the same shape as the selected cam only smaller.

Conversely, if the operator wishes to have the stone generally the same shape though somewhat larger, he will loosen the nut 52 and slide the roller 46 and plate 44' from right to left, from its position in Fig. 2, a selected amount to thereby move the forward edge 83 of the roller to the left of the line 84 and to the left of the forward edge of the grinding wheel a selected amount. He will then back the plate 26 away from right to left when viewed from FIG. 2 to allow clearance to attach the stone by its stick into the chuck and then move the plate 26 slowly forward with the grinding wheel grinding the stone while the motor 35 rotates the cam shaft and stone when the selected cam is in continuous engagement with the roller. The grinding will be complete and the stone will have generally the same shape as the selected cam though somewhat larger depending upon the amount of adjustment.

After the stone has been ground to its selected shape the rod will be removed from the stone by glue solvent or other suitable means.

Additional cams may be added to the cam shaft to provide additional variations in size and shape for shaping neck pendants. Also, the cams may be made detachable from the shaft.

Thus, it will be seen that a novel apparatus has been provided for rapidly and selectively grinding a stone into a desired shape and size for a neck pendant and the like.

It will be obvious that various changes and departures may be made to the invention without departing from the spirit thereof and accordingly it is not intended that the invention be limited to that specifically described in the specification or as illustrated in the drawings, but only as set forth in the appended claims wherein.

I claim:

1. A stone grinding device for grinding stones for neck pendants into desired shapes and sizes, comprising a main frame and a sliding frame, a rotary grinding wheel in a fixed position on said main frame, means to slide said sliding frame transverse to the axis of rotation of said grinding wheel, a cam shaft support apparatus having a pair of arms pivotally mounted at one end to said sliding frame, a cam shaft rotatably mounted at the other end of said arms, an adjustable roller, a plurality of cams of different sizes and shapes on said cam shaft, a stone supporting shaft, a motor means mounted on said cam shaft for rotating said cam shaft, said cam shaft having a drill chuck mounted at one end of said cam shaft to receive and lock said stone supporting shaft to support the stone thereon from only one end of said cam shaft with said grinding wheel in front of said stone for grinding, means to adjust said roller along an axis parallel to said cam shaft in front of a selected one of said cams, spring means urging said cam shaft toward said roller, so that said stone to be ground will engage said grinding wheel, said selected cam having variations in its outer surface so that said selected cam is rotated by said cam shaft, said selected cam will push said cam shaft away and allow it to move toward said roller depending upon the variations, so that the grinding wheel will push said cam shaft away or allow it to move toward the roller depending upon the variations, so that the grinding wheel will grind the stone at the end of the cam shaft into shape variations of the selected cam.

* * * * *